US006715330B2

(12) United States Patent
Jansson

(10) Patent No.: US 6,715,330 B2
(45) Date of Patent: Apr. 6, 2004

(54) DEVICE AND METHOD FOR PRESSING A PLASTICALLY DEFORMABLE BLANK

(75) Inventor: Mark Jansson, Borås (SE)

(73) Assignee: Markram Development AB, Borås (SE)

( * ) Notice: Subject to any disclaimer, the term of this patent is extended or adjusted under 35 U.S.C. 154(b) by 0 days.

(21) Appl. No.: 10/203,029

(22) PCT Filed: Feb. 14, 2001

(86) PCT No.: PCT/SE01/00291

§ 371 (c)(1),
(2), (4) Date: Aug. 5, 2002

(87) PCT Pub. No.: WO01/60583

PCT Pub. Date: Aug. 23, 2001

(65) Prior Publication Data

US 2003/0011101 A1 Jan. 16, 2003

(30) Foreign Application Priority Data

Feb. 18, 2000 (SE) ..... 0000526

(51) Int. Cl.[7] ..... B21C 23/00

(52) U.S. Cl. ..... 72/256; 72/263; 72/467; 72/468

(58) Field of Search ..... 72/256, 260, 263, 72/467, 468, 469

(56) References Cited

U.S. PATENT DOCUMENTS

| | | | | | |
|---|---|---|---|---|---|
| 3,394,431 A | | 7/1968 | Nalle, Jr. | | |
| 3,422,648 A | * | 1/1969 | Lemelson | ..... | 72/256 |
| 3,525,785 A | | 8/1970 | Fairbanks | | |
| 3,600,918 A | * | 8/1971 | Lemelson | ..... | 72/256 |
| 4,074,557 A | | 2/1978 | Yanagimoto et al. | | |
| 4,413,973 A | | 11/1983 | Peters | | |

FOREIGN PATENT DOCUMENTS

| | | | | | |
|---|---|---|---|---|---|
| DE | 4201746 | | 7/1993 | | |
| FR | 2130986 | | 11/1972 | | |
| JP | 56-111535 | * | 9/1981 | ..... | 72/256 |
| JP | 58-61915 | * | 4/1983 | ..... | 72/256 |
| JP | 1-241336 | * | 9/1989 | ..... | 72/256 |
| WO | 97/12745 | | 4/1997 | | |

* cited by examiner

*Primary Examiner*—Ed Tolan
(74) *Attorney, Agent, or Firm*—Burns, Doane, Swecker & Mathis, L.L.P.

(57) ABSTRACT

The invention concerns a device and a method for continuous pressing of a plastically deformable blank into a three-dimensional section with a predetermined cross-sectional area, comprising a substantially cylindrical, fixed die, an opening formed in the die, through which the plastic blank is intended to be pressed, and at least one rotary die arranged adjacent to the opening, the rotary die having one or more recesses in its peripheral surface for forming the blank, during the rotation of the die, into at three-dimensional section with transverse sectional parts. According to the invention, the rotary die has a varying pitch radius as measured from the axis (C), which allows pressing of sections with varying cross section.

31 Claims, 8 Drawing Sheets

DEVICE AND METHOD FOR PRESSING A PLASTICALLY DEFORMABLE BLANK

TECHNICAL FIELD

The present invention relates to a device and a method for continuous pressing of a plastically deformable blank, for example made of a metal, into a three-dimensional section with a predetermined cross-sectional area, comprising a fixed die with an opening formed in the die, through which the plastically deformable blank is intended to be pressed, and at least one rotary die arranged, adjacent to the opening, around an axis extending transversely of the pressing direction, the die having one or more recesses in its peripheral surface for forming the blank into a three-dimensional section with transverse sectional parts during the rotation of the rotary die.

TECHNICAL BACKGROUND

In continuous pressing of a plastically deformable blank, for example a heated metal such as aluminium, so-called extrusion, the blank passes an opening with a desired cross-sectional area, thereby forming a section whose longitudinal cross-section is constant. There is a great need for continuous manufacture of sections with transverse sectional parts, such as racks, hollow sections, etc.

International Patent Specification WO97/12745 discloses a method and a device invented by the present inventor, which aim at allowing extrusion of sections with sectional parts protruding transversely of the section. According to this publication, a rotating die is arranged to constitute part of the opening through which the blank is pressed. As the cross-sectional area of the blank is being reduced, the rotating die simultaneously forms it. The rotating die can be designed to produce transverse bars in the section, or to form a raised or embedded company name in the section.

The difference compared to various types of die stamping with rotating elements is to be noted, illustrated for example in DE 42101746, where only a very limited forming of the blank takes place. When shaping according to the above technique, as referred to by the present invention, the rotating die forms part of the actual extrusion process.

The application of this technique in existing, largely standardised, press facilities such as hydraulic pressing plants, screw extruders, conform extrusion machines, etc, was previously impossible. Facilities of said type usually comprise a tool arrangement of the type shown in FIG. 2, with a support 5 for a substantially cylindrical tool 3 comprising a fixed die 1. There is not much space around this tool, and the forces generated during the pressing are very strong.

Furthermore, it is very important that the number of production stoppages be reduced, since the cost of unexploited machine capacity is very high. It is, therefore, desirable that tools can be changed rapidly according to pressing needs.

Since Patent Specification WO97/12745 was published, the need for sections with a cross-sectional area that varies longitudinally has arisen, i.e. a section having not only transverse sectional parts such as bars, but also a varying cross-section or material thickness along the continuous section.

SUMMARY OF THE INVENTION

The object of the present invention is to solve the above problem, and permit extrusion of sections with longitudinally varying material thickness.

This object is achieved by means of a device and a method of the type described by way of introduction, wherein the rotary die has a varying pitch radius as seen from the axis, which allows pressing of sections with varying cross section.

The term "pitch radius" is used here in the same way as in the description of a gear wheel, i.e. the average radius of the whole die or parts of the die. Accordingly, the pitch radius takes up a peripheral surface in which various kinds of recesses or protrusions have been made to form the sections. A varying pitch radius may be achieved by a non-circular die (for example an oval die), or by the rotary die being slightly offset relative to said axis. This would result in a section, whose continuous material thickness would vary cyclically, which is desirable when manufacturing a beam with varying strength.

According to a preferred embodiment, the device further comprises means for varying the cross-sectional area immediately upstream of the rotary die. In other words, the fixed die is arranged to have an opening with a variable cross section. Thus, the amount of material pressed towards the rotary die may be varied, suitably according to the shape of the rotary die. The means for varying the cross-sectional area are suitably synchronised with the rotary die and may consist of supporting surfaces moveable transversely of the pressing direction.

According to a second aspect of the invention, the rotary die is arranged to be lockable in a predetermined position. Thus, the rotary, moveable die may be locked, and thereby essentially converted into a fixed die. Pressing may now take place, either by passing one rotary die or by passing one or more fixed dies, which offers improved possibilities of varying the pressed sections.

The rotary die may suitably have smooth sectors, which in the locked position face the blank, so that, in this position, the blank passes the locked die for forming a smooth sectional segment. By orienting a smooth sector so that it faces the blank when locking the rotary die, the forces acting on the rotary die in the locked position are minimised. Locking the rotary die in a position where recesses or protrusions are oriented so that they face the blank would in fact require a great locking force and would, in addition, mean a risk of loose pieces forming in the cavities of the die during pressing.

According to a third aspect of the invention, the rotary die is arranged immediately downstream of said opening, whereby the blank is reduced when passing through said opening down to substantially the predetermined cross-sectional area, and then formed when passing said rotary die, so that the final shape of the three-dimensional section is determined.

Unlike prior art, the area of the blank is in this case reduced down to substantially its final cross-sectional area upstream of the rotating die, whereby the forces acting on the rotating die can be minimised. This results in manageable bearing forces, which allows the bearings of the rotary die to be contained in the fixed die. The expression "substantially down to" means primarily down to between 100% and 130% of the final predetermined cross-sectional area.

The blank meets with the rotating die radially within its average radius (the pitch radius). In this way, some area reduction still takes place at the rotating die, and thus a certain acceleration of the blank occurs during this passage while at the same time the material fills cavities in the rotating die.

The expression "immediately downstream of" means that the rotary die is located so close to the opening that the pressure of the pressing is used in the shaping done by the rotating die. If the distance is too long, for example several times the across corner dimension of the section, the blank will self-lock adjacent to the rotating die because of the friction caused upstream against the supporting surfaces when the rotating die is in a pressing phase.

The rotary die is preferably mounted in bearings in a transverse cavity formed next to the opening, thereby being rotatable around an axis extending transversely of the pressing direction.

This design of the fixed die allows a space-efficient location of the rotary die within the machine. Furthermore, this construction means that the rotary die is easily accessible, since it is relatively easy to loosen and remove the tool in a normal compression moulding machine. Thus, the device can be designed so as to be compatible with conventional extruding machines in order to allow rapid changing of tools without the need for expensive production stoppages.

By forming a cavity in the fixed die, the space is used as much as is possible, and, in addition, a smaller amount of toughened material is needed for the fixed die, which reduces the cost.

The rotary die is preferably mounted in bearings with a certain axial play. This play allows some thermal expansion of the rotating die without causing any jamming.

The rotary die may be fixedly arranged on a shaft mounted in bearings in the cavity, the shaft having a limited axial play. Thus, owing to this construction the shaft is axially guided by the rotary die. Since the shaft and its bearings are arranged in the fixed die, this constitutes a unit in which the rotary die is arranged, the unit being easily replaceable. Moreover, the shaft may be relatively short, which results in a favourable load take-up capacity and less load on the bearings.

A shaft portion extending through the rotary die may be made of a material with a higher thermal expansion coefficient than the rotary die, so that said shaft portion, when the rotary die and the shaft are heated during pressing, expands more than the rotary die, which is thereby secured to the shaft. By using this technique to secure the rotary die, the need for securing elements in the shaft and the die is eliminated.

The opening preferably comprises a recess in the fixed die on the upstream side, which is intended to cause a first cross-sectional reduction of the material, the recess being substantially formed on the side of the opening opposite to the cavity. By forming the recess in this way, there is less stress on the fixed die at the cavity in which the rotary die is arranged. In a traditional type of tool, where the corresponding recess usually is symmetrical, the material around the cavity may become too thin.

BRIEF DESCRIPTION OF THE DRAWINGS

The present invention will be described in more detail below with reference to the accompanying drawings, which by way of example illustrate preferred embodiments of the invention.

DESCRIPTION OF A PREFERRED EMBODIMENT

Figure 1:
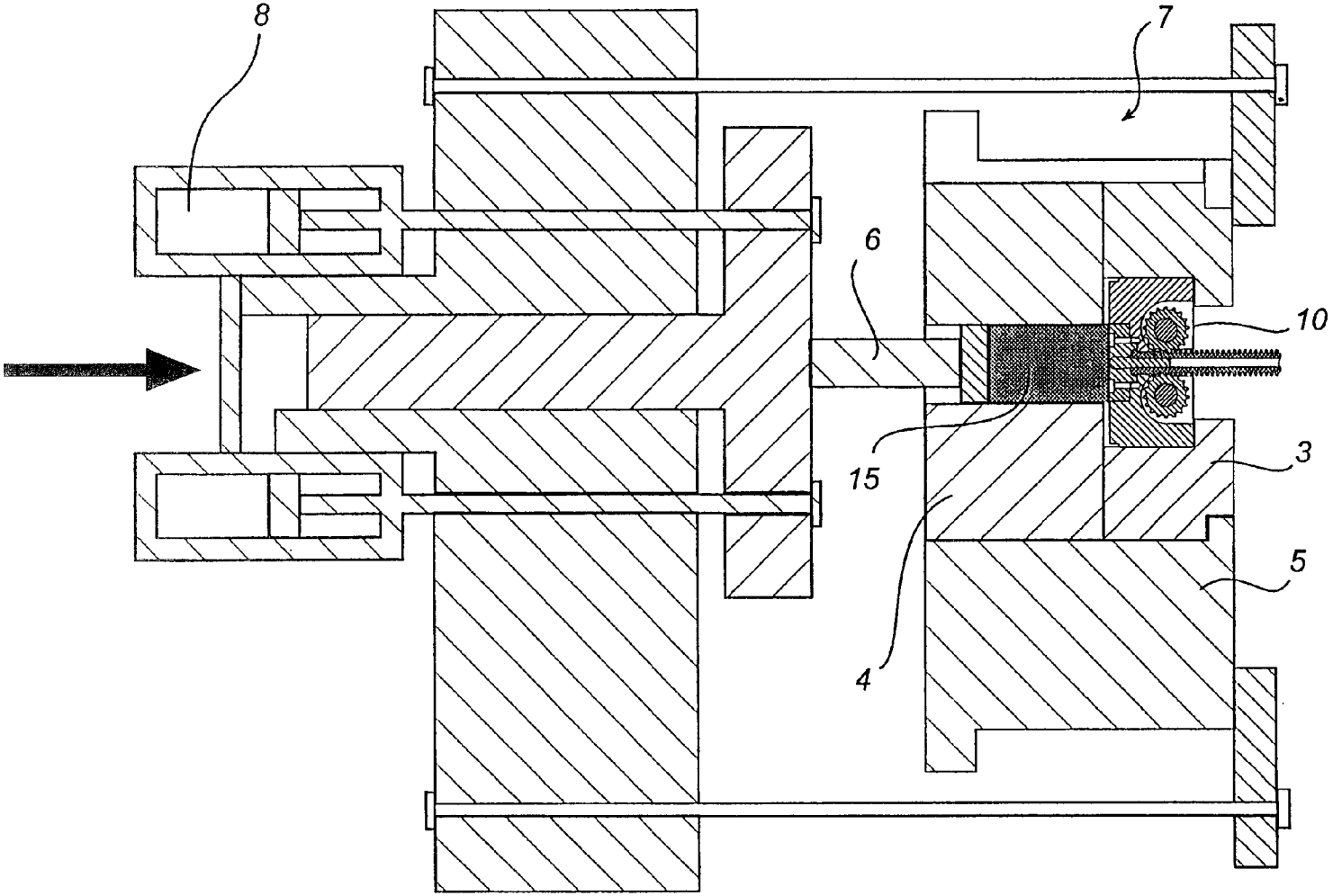
FIG. 1 is a schematic representation of an example of an extruding machine.

FIG. 1 is a rough schematic representation of a machine intended for extrusion of metals such as aluminium, which have been heated to a plastically deformable state, wherein a ram 6 is arranged by means of hydraulic actuators 8 to press a blank 15 towards a tool arrangement 7.

Figure 2:
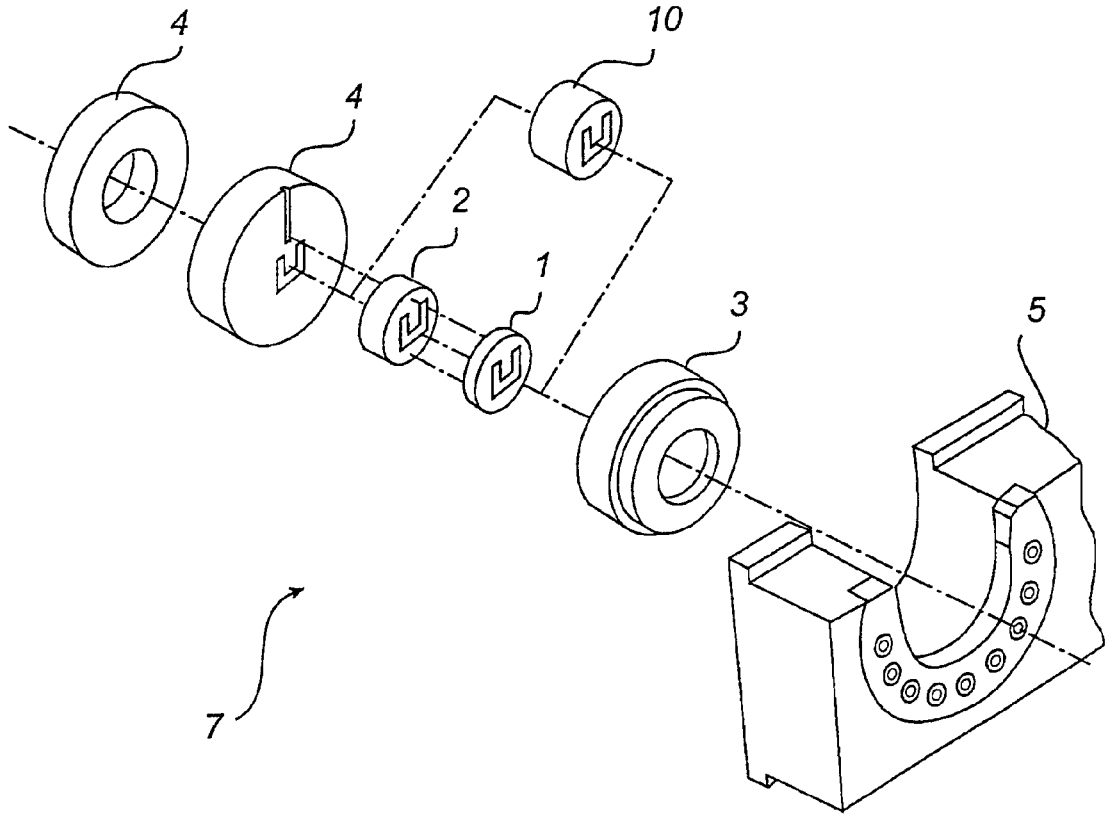
FIG. 2 is an exploded view of a tool arrangement in an extruding machine.

FIG. 2 is an exploded view of the tool arrangement 7. The tool arrangement comprises a die 1 which, together with a supporting element 2, is arranged in a annular die holder 3 located in front of one or more rear members 4 in a tool support 5 (also called "horseshoe"). The die 1 and the supporting element 2 can be replaced by a device according to the invention, or alternatively the dimensions of the die 10 according to the invention may be such that also the die holder 3 is excluded from the tool arrangement.

The die unit shown in FIGS. 3–6 comprises a substantially cylindrical, fixed die 10 with an opening 11 and a rotary die 12. A blank 15 is intended to be pressed through the opening 11 in a pressing direction A. A second opening 17 is defined between the rotary die 12 and an opposite, preferably plane, supporting surface 18 in the material of the fixed die 10.

The blank 15 passing the opening 11 is brought in contact with the rotary die 12 approximately on a level with its inside radius r1, preferably slightly within the radius r1. If a rotary die 12 in the form of a gear wheel 19 is used, as in the example shown, r1 designates the pitch radius of the gear wheel, which makes up a peripheral surface from which the gear teeth 21 extend. It is important, regardless of the shape of the die 12, for the blank to hit the die on such a level that the blank 15 is plastically deformed during the passage past the rotating die 12. The deformation of the blank 15 is shown in more detail in the enlarged view in FIG. 6.

Figure 5:
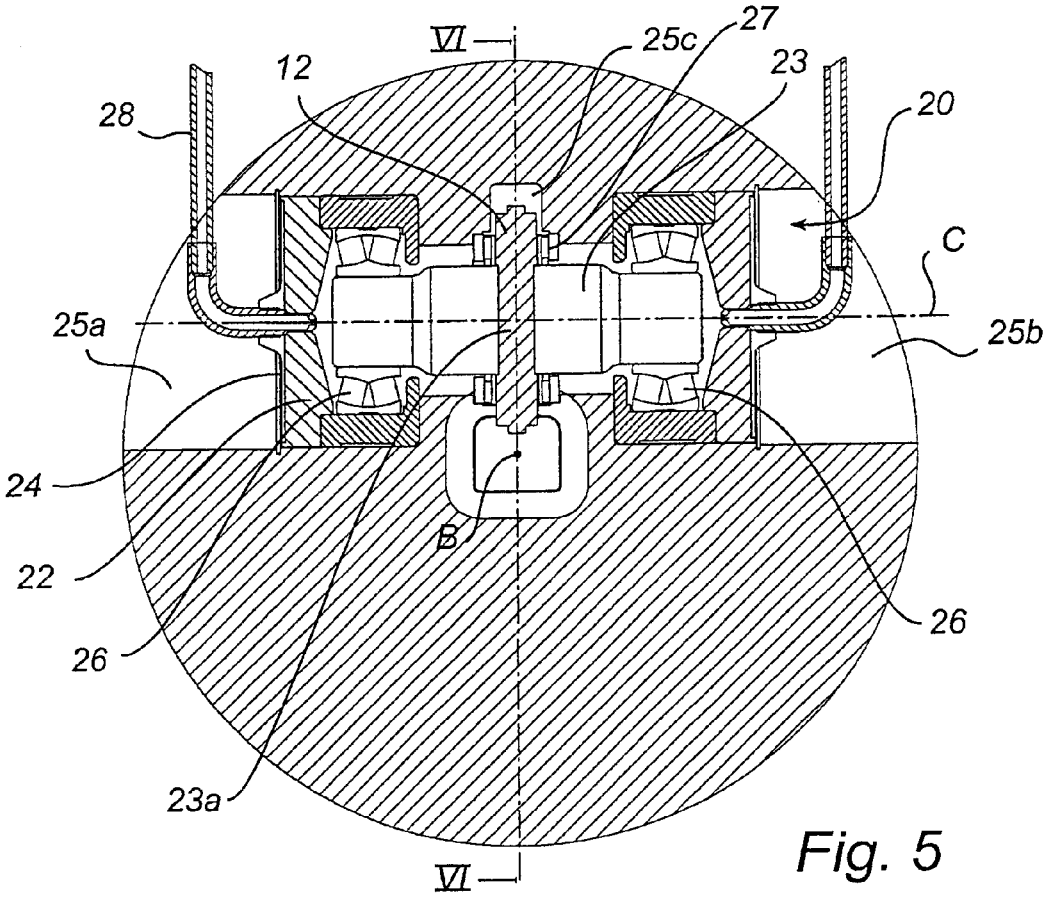
FIG. 5 is a cross-sectional view of the die in FIG. 3.
Figure 6:
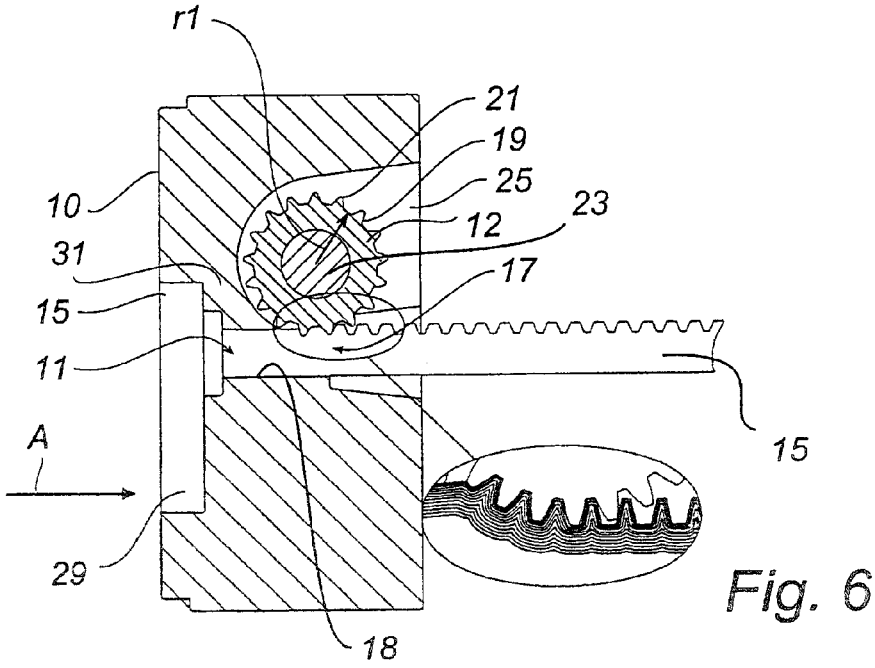
FIG. 6 is a cross-sectional view of the die in FIG. 3 along the line VI—VI in FIG. 5.

With reference primarily to FIG. 5, it is shown how the rotary die 12 is rotatable around an axis C. More particularly, it is fixedly mounted on a shaft 23 mounted in bearings in a cavity 20 in the fixed die 10. The cavity 20 consists essentially of a transverse boring 25*a–c* formed beside the centre axis B of the die and extending transversely of the pressing direction A. The boring 25*a–c* has a larger cross section in the areas 25*a*, 25*b*, at the respective ends, close to the edge of the die unit. Immediately inside these areas, the cross section of the boring is smaller, getting larger again, finally, in the most central part 25*c*. In the areas 25*a*, 25*b*, two bearings 26 are arranged, for example roller bearings or slide bearings, through which the shaft 23 extends over the whole length of the boring. The die 12 is arranged in the central area 25*c* and fixed laterally by axial bearings 27 arranged in the area 25*c*.

In the example shown, means for cooling the bearings 26 are arranged in the die unit. The means comprise a ceramic body 22 that is fitted axially outside each bearing, a seal 24 located outside the body 22, and a supply conduit 12 for a cooling agent, such as nitrogen or the like.

The die 12 is suitably made of a material with a lower thermal expansion coefficient than at least the central shaft portion 23*a* on which it is applied. In this way, the die 12 is effectively secured when the temperature of the whole die rises as a result of the extrusion.

Figure 3:
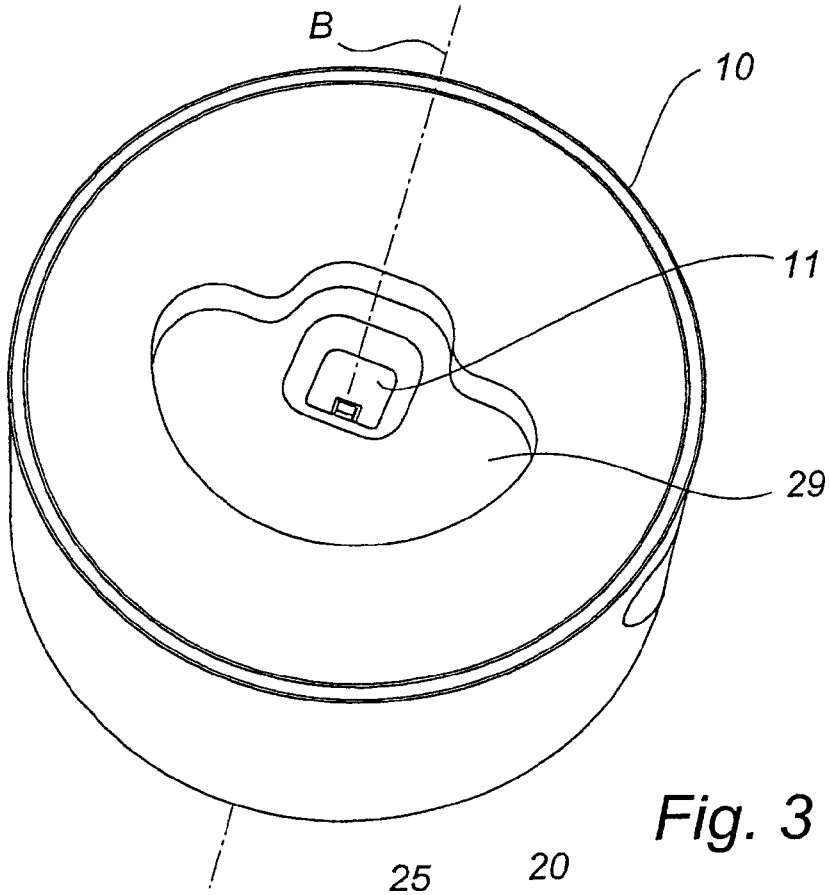
FIG. 3 is a rear perspective view of a die according to a first embodiment of the invention.

With reference to FIG. 3, which is a front perspective view of the fixed die 10, i.e. as seen from the point from which the blank 15 is pressed, the opening 11 comprises a recess 29 in the die, the recess causing a first reduction of the area when pressing. This recess 29 is asymmetrically shaped in relation to the centre axis B of the die, and the major part of it is located on the side opposite to the cavity 20. Shaping the recess 29 this way minimises those portions 31 of the die that are weakened, in the pressing direction A, both by the cavity 20 and the recess 29 (see FIG. 6).

Figure 4:
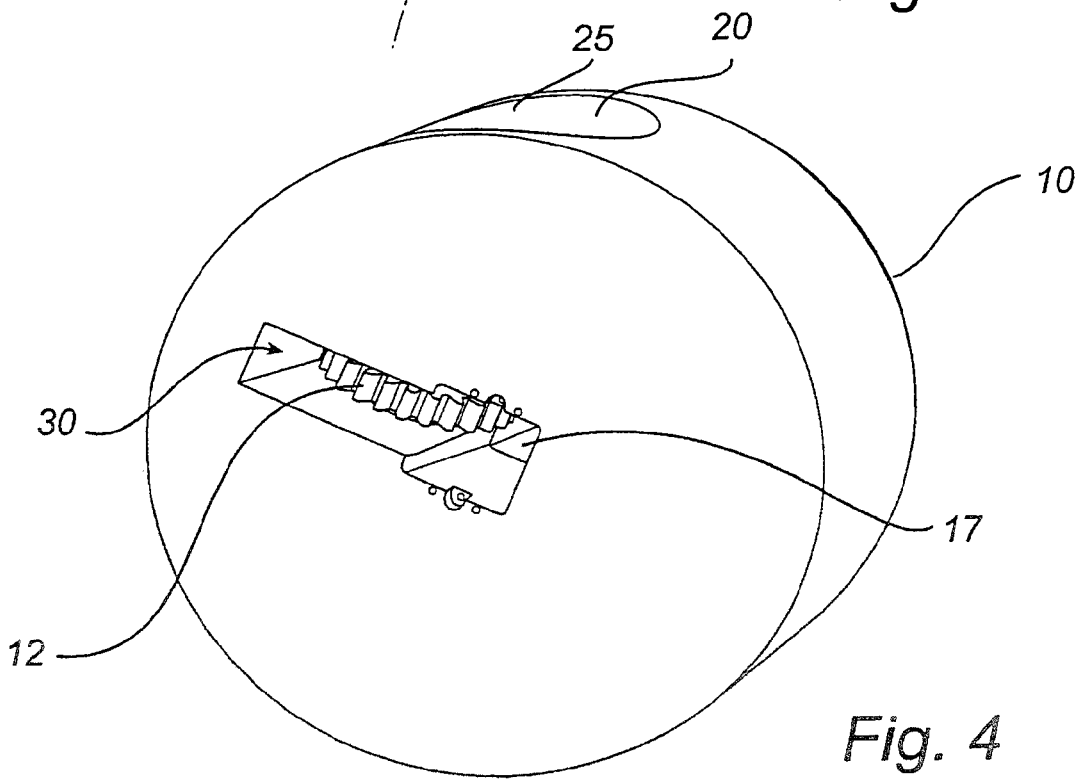
FIG. 4 is a front perspective view of the die in FIG. 3.

It appears from FIG. 4 that the cavity 20 also has an orifice 30 on the front of the fixed die 10, through which the rotary die 12 is visible. The rotary die 12 is mounted by being inserted through the orifice 30, and then by the shaft 23 being inserted through the boring 25 and through the rotary die 12.

Figure 7:
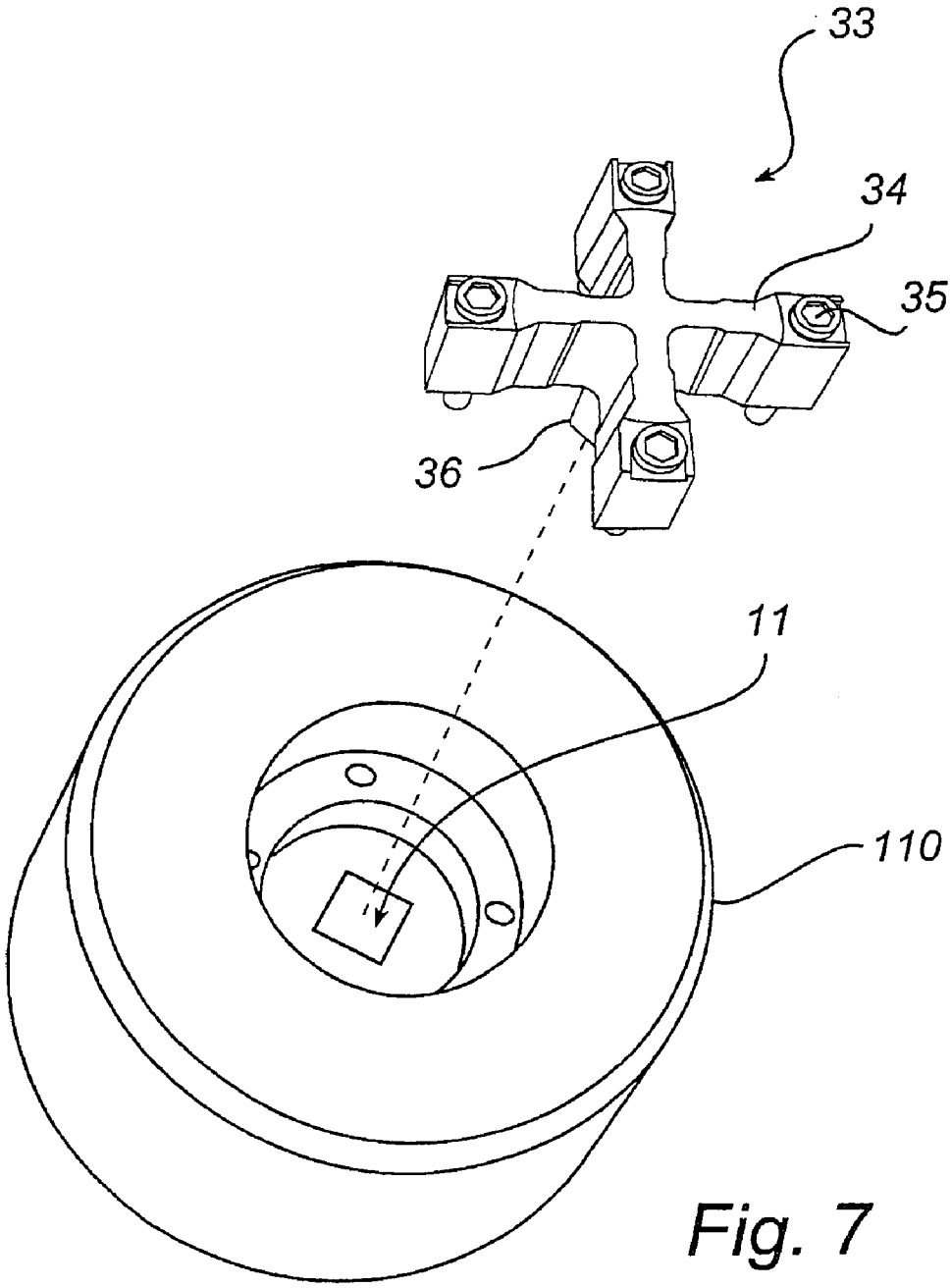
FIG. 7 is a partly exploded view of a die according to a second embodiment of the invention.
Figure 8:
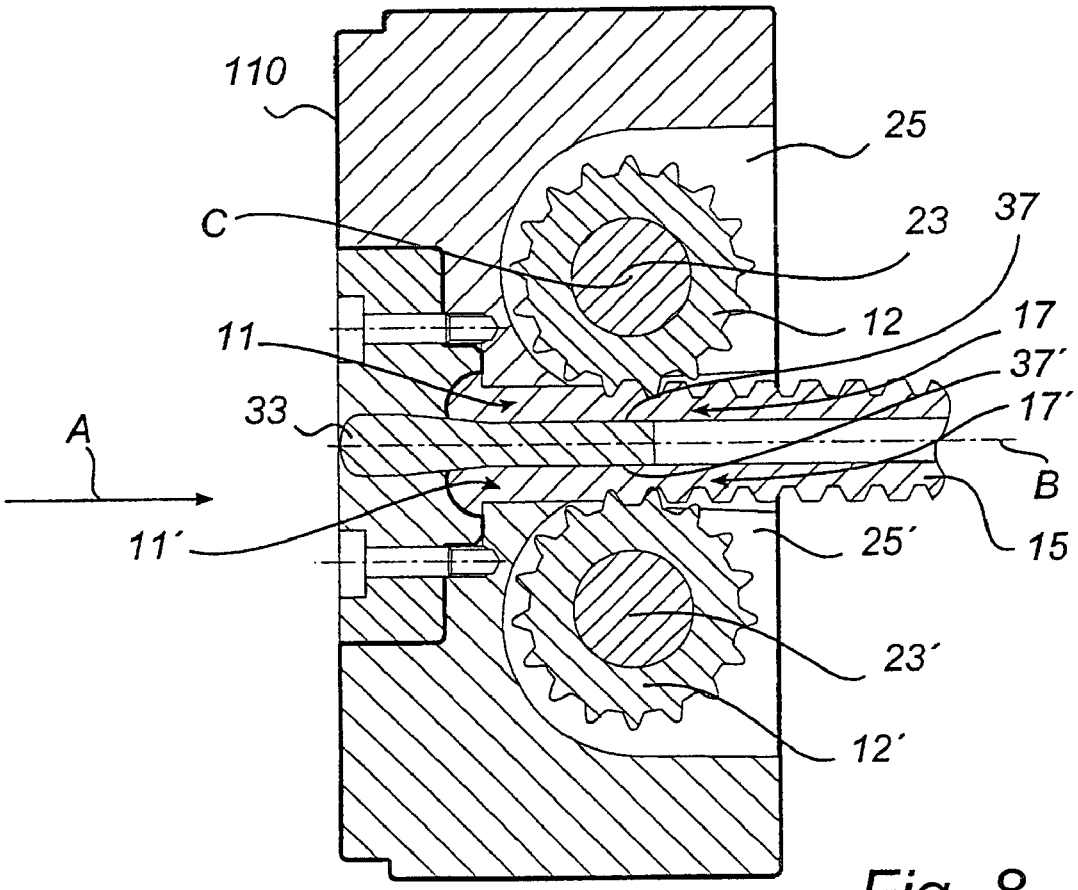
FIG. 8 is a cross-sectional side view of the die in FIG. 7.

According to a second embodiment (FIGS. 7–8) of the invention, a fixed die 110 comprises two rotary dies 12, 12', each arranged on a shaft 23, 23' in a boring 25, 25'. This construction permits pressing of sections that are profiled both on the upper side and on the underside.

The two dies may be synchronised with each other in any appropriate way, for example by providing gear wheels to join the shafts 23, 23'. Through the synchronisation the distribution of the load take-up between the dies 12, 12' is improved.

The fixed die 110 further comprises a core die 33 fixedly arranged on the die 110 and extending through the opening 11, the opening being divided in two openings 11, 11', thereby permitting pressing of a hollow section. The core die 33, as shown in the perspective view of FIG. 7, comprises, in the embodiment shown, a cruciform portion 34, intended to be fixedly arranged on the die with the aid of fixing means 35 such as bolts, and an elongated portion 36, intended to extend, once the core die is arranged on the die, through the opening 11 as far as or past the centre of the rotary dies. The side 37 of the core die facing the rotary die 12 thereby replaces the above mentioned supporting surface 18 as the element defining the opening 17 while at the same time the opposite side 37' defines a second opening 17'.

Figure 9A:
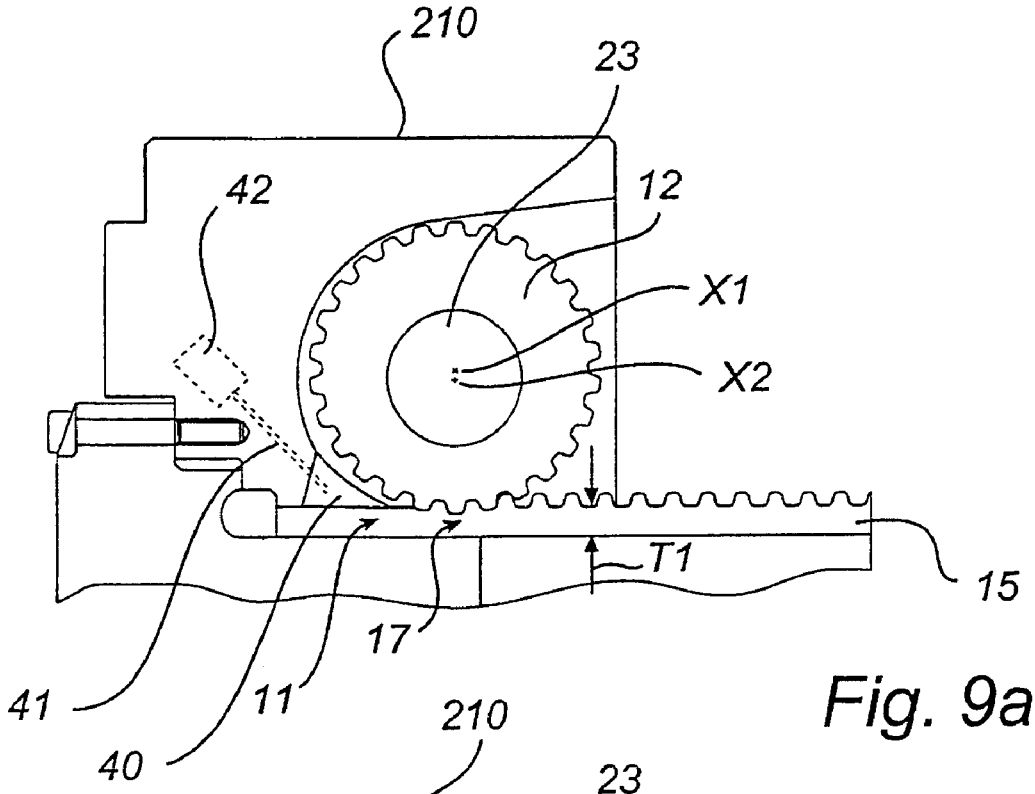
FIGS. 9*a, b* are cross-sectional views of a die according to a further embodiment of the invention, with the rotary die in two different positions.
Figure 9B:
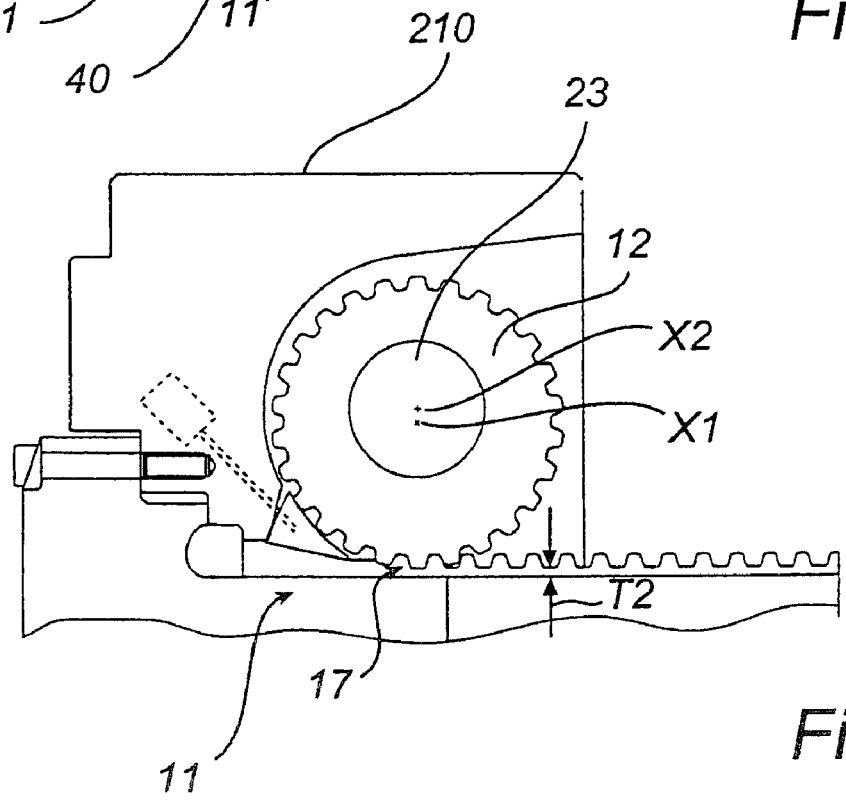

The rotary die according to the invention has a varying pitch radius. In the die 210 shown in FIGS. 9*a*–9*b*, the rotary die 12 is arranged on the shaft 23 slightly offset from the shaft centre. Thus, as illustrated in FIG. 9*a*, the material of the pressed section gets a larger cross section T1 when the centre X1 of the rotary die is located above the shaft centre X2 whereas, as illustrated in FIG. 9*b*, the material of the pressed section gets a smaller cross section T2 when the centre X1 of the rotary die is located below the shaft centre X2. Another way of achieving the varying pitch radius, and thereby a varying material thickness, is to provide an oval die as the rotary die 12.

In order to adapt the cross-sectional area of the blank 15 pressed against the opening 17 to these altered cross sections a supporting surface 40 is arranged to reduce the opening 11 in FIG. 9*b*. The movable supporting surface 40 is controlled by actuators 42 via link means 41, only schematically illustrated in FIGS. 9*a–b,* and is arranged to adjust the opening 11 depending on the size of the opening 17 between the rotary die 12 and the core die 33 (alternatively the supporting surface 18 in the absence of the core die 33). As shown in FIGS. 9*a* and 9*b*, the supporting surface 40 may be moved between a first starting position (FIG. 9*a*) and a second lowered position (FIG. 9*b*), in which the opening 11 is reduced.

Figure 10B:
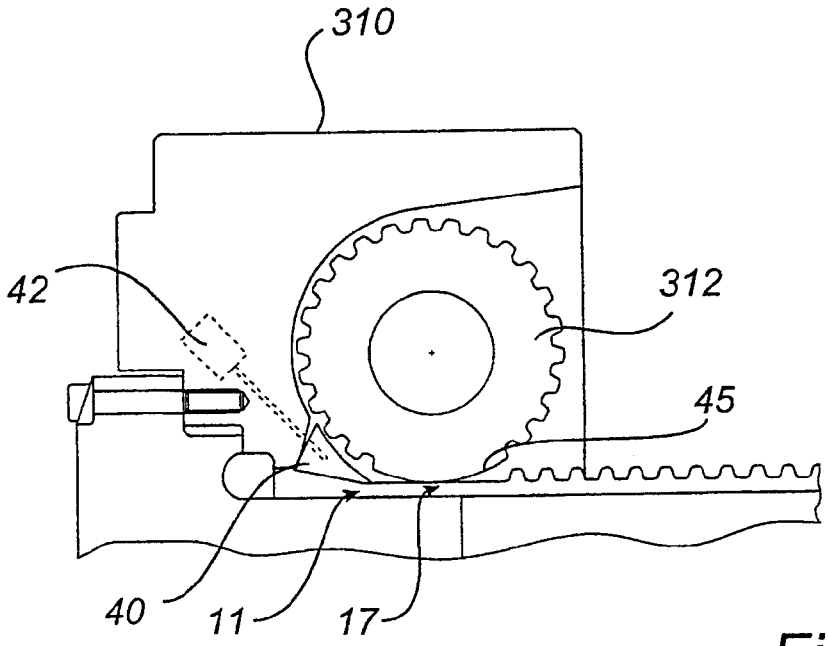
FIGS. 10*a, b* are cross-sectional views of a die according to a further embodiment of the invention, with the rotary die in two different positions.
Figure 10A:
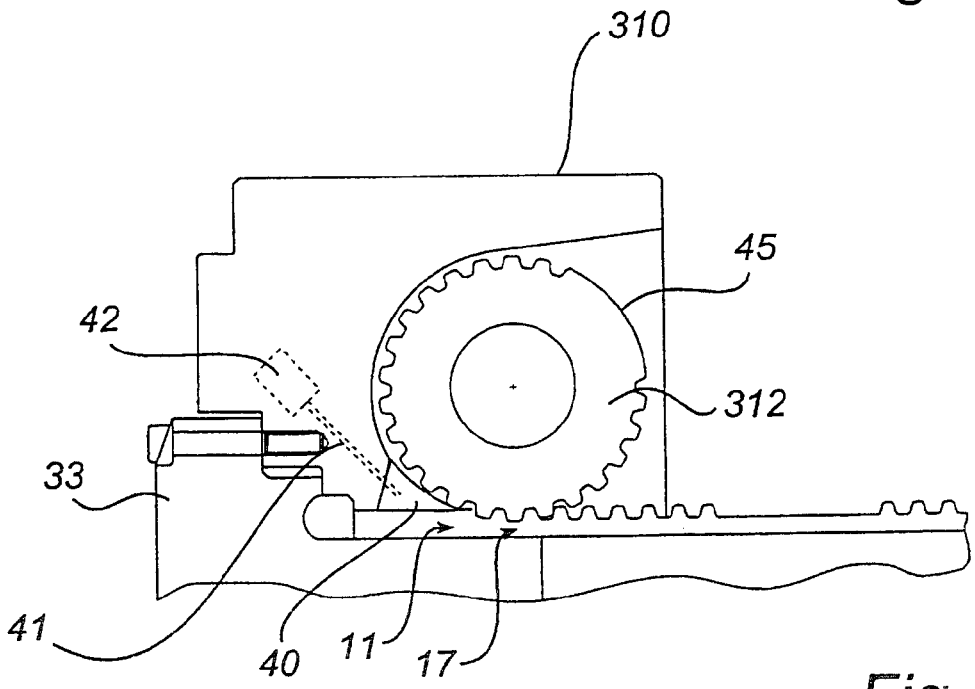

Another situation when a moveable supporting surface may be suitable is when using a die 310 as shown in FIGS. 10*a–b*. This die is provided with a rotary die 312 having smooth portions 45, which take up an angle sector that is several times bigger than the usual protrusions (gear teeth). In the example shown, a smooth portion 45 is formed in the rotary die 312 taking up about 30 degrees of the circumference of the die 312. In FIG. 10*a* pressing is performed in the same way as described above, with the supporting surface 40 in the starting position. In FIG. 10*b*, however, the smooth portion has reached the opening 17, which is thereby given a reduced cross-sectional area. In order to achieve a satisfactory extrusion also in this position, the supporting surface 40 is moved to a lowered position by the actuators, whereby the opening 11 is reduced.

Furthermore, the die 312 in FIGS. 10*a–b* may be arranged to be lockable in the position shown in FIG. 10*b*. When the die is in this locked position a straight section without transverse sectional parts can be extruded between the smooth portion 45 of the die 312 and the core die 33, alternatively the supporting surface 18.

It is to be noted that FIGS. 9 and 10 are only intended to illustrate the principle behind the described embodiments of the invention. A person skilled in the art realises that several of the distances shown in the figures do not correspond to reality, for example in the case of the inclination of the supporting surface 40, which is exaggerated in order to facilitate understanding. As a consequence of this exaggeration also the distance between the supporting surface and the rotating die 12, 312 is slightly too long.

The rotary dies described above may be arranged, as appropriate, to be driven, thereby adding extra power to the extrusion process. A person skilled in the art can provide this drive, for example by connecting the shaft 23, 23' to a driven shaft arranged in the tool support 5. In particular, this drive may be advantageous when pressing sections with varying material thickness, for example as shown in FIGS. 9*a*, 9*b*.

It will be appreciated that details of the embodiments shown in the figures and described above can be combined in an optional way. For example, the core die 33 shown in FIGS. 8, 9*a–b* and 10*a–b* may be excluded when pressing solid sections. The number of rotary dies may vary in all embodiments, and it is mainly for the sake of clarity that most figures show only one die.

What is claimed is:

1. A device for continuous pressing of a plastically deformable blank into a three-dimensional section with a predetermined cross-sectional area, comprising a fixed die with an opening formed therein, through which the plastically deformable blank is intended to be pressed, and at least one die arranged adjacent to the opening and rotatable around an axis extending transversely of the pressing direction, the die having one or more recesses in its peripheral surface for forming the blank into a three-dimensional section with transverse sectional parts during the rotation of the die, wherein the rotary die has a varying pitch radius as seen from the axis, which allows pressing of sections with varying cross section.

2. A device according to claim 1, wherein the centre of the die is slightly offset relative to the axis.

3. A device according to claim 1, wherein the rotary die is oval.

4. A device according to claim 1, further comprising means for varying the cross-sectional area of the opening immediately upstream of the rotary die.

5. A device according to claim 4, wherein the means for varying the cross-sectional area are synchronised with the rotary die.

6. A device according to claim 5, wherein the means for varying the cross-sectional area includes at least one supporting surface moveable transversely of the pressing direction.

7. A device according to claim 4, wherein the means for varying the cross-sectional area includes of at least one supporting surface moveable transversely of the pressing direction.

8. A device according to claim 1, wherein the rotary die is arranged to be lockable in a predetermined position.

9. A device according to claim 8, wherein the rotary die has smooth portions which, in the locked position, are oriented towards the blank, so that, in this position, the blank passes the locked die to form a smooth sectional segment.

10. A device according to claim 1, wherein the rotary die is arranged immediately downstream of said opening, the blank is reducible, when passing through the opening, down to substantially the predetermined cross-sectional area, and then is formable, when passing the rotary die, so that the final shape of the three-dimensional section is determined.

11. A device according to claim 1, wherein a cavity located next to one side of the opening is formed in the fixed die, and wherein the rotary die is mounted in bearings in the cavity.

12. A device according to claim 11, wherein the rotary die is axially mounted in bearings with a limited axial play.

13. A device according to claim 12, wherein the rotary die is fixedly arranged on a shaft mounted in bearings in the cavity, the shaft having a limited axial play.

14. A device according to claim 13, wherein a portion of the shaft, the portion extending through the rotary die, is made of a material with a higher thermal expansion coefficient than the rotary die, so that the shaft portion, when the die and the shaft are heated during pressing, expands more than the die, which is thereby secured to the shaft.

15. A device according to claim 11, wherein the fixed die further comprises a recess formed upstream of the opening and intended to cause a first cross-sectional reduction of the blank, the recess being substantially formed on the side of the opening opposite to the cavity.

16. A device according to claim 1, wherein the rotary die is driven.

17. A method for pressing a plastically deformable blank into a three-dimensional section with a predetermined cross-sectional area, comprising pressing the blank past an opening of at least one die rotatably arranged around an axis extending transversely of the pressing direction and having one or more recesses in its peripheral surface, so that the blank is formed by the rotation of the die, thereby determining the final shape of the three-dimensional section, wherein the rotary die has a varying pitch radius as seen from the axis, which allows pressing of sections with varying cross section.

18. A method according to claim 17, wherein the axis is slightly offset relative to the centre of the die.

19. A method according to claim 17, wherein the rotary die is oval.

20. A method according to claim 17, wherein the cross-sectional area of the opening is varied according to the shape of the rotary die and the predetermined cross-sectional area of the three-dimensional section.

21. A method according to claim 17, wherein the rotary die is locked in a predetermined position, so that, while the rotary die is locked, the blank is pressed into a section without transverse sectional parts.

22. A method according to claim 17, wherein the blank is caused to pass an opening immediately upstream of the rotary die, and the blank, when passing through the opening, is reduced down to substantially the predetermined cross-sectional area.

23. A method according to claim 18, wherein the cross-sectional area of the opening is varied according to the shape of the rotary die and the predetermined cross-sectional area of the three-dimensional section.

24. A method according to claim 19, wherein the cross-sectional area of the opening is varied according to the shape of the rotary die and the predetermined cross-sectional area of the three-dimensional section.

25. A method according to claim 18, wherein the rotary die is locked in a predetermined position, so that, while the rotary die is locked, the blank is pressed into a section without transverse sectional parts.

26. A method according to claim 19, wherein the rotary die is locked in a predetermined position, so that, while the rotary die is locked, the blank is pressed into a section without transverse sectional parts.

27. A method according to claim 20, wherein the rotary die is locked in a predetermined position, so that, while the rotary die is locked, the blank is pressed into a section without transverse sectional parts.

28. A method according to claim 18, wherein the blank is caused to pass an opening immediately upstream of the rotary die, whereby the blank, when passing through the opening, is reduced down to substantially the predetermined cross-sectional area.

29. A method according to claim 19, wherein the blank is caused to pass an opening immediately upstream of the rotary die, whereby the blank, when passing through the opening, is reduced down to substantially the predetermined cross-sectional area.

30. A method according to claim 20, wherein the blank is caused to pass an opening immediately upstream of the rotary die, whereby the blank, when passing through the opening, is reduced down to substantially the predetermined cross-sectional area.

31. A method according to claim 21, wherein the blank is caused to pass an opening immediately upstream of the rotary die, whereby the blank, when passing through the opening, is reduced down to substantially the predetermined cross-sectional area.

* * * * *